US012031427B2

(12) United States Patent
Gomes et al.

(10) Patent No.: US 12,031,427 B2
(45) Date of Patent: Jul. 9, 2024

(54) DOWNHOLE RECEPTACLE FOR TRACER INSTALLATION

(71) Applicant: Abu Dhabi National Oil Company, Abu Dhabi (AE)

(72) Inventors: Jorge S. Gomes, Abu Dhabi (AE); Ahmed Al Shmakhy, Abu Dhabi (AE)

(73) Assignee: Abu Dhabi National Oil Company, Abu Dhabi (AE)

( * ) Notice: Subject to any disclaimer, the term of this patent is extended or adjusted under 35 U.S.C. 154(b) by 155 days.

(21) Appl. No.: 17/774,703

(22) PCT Filed: Nov. 7, 2019

(86) PCT No.: PCT/IB2019/059578
§ 371 (c)(1),
(2) Date: May 5, 2022

(87) PCT Pub. No.: WO2021/090048
PCT Pub. Date: May 14, 2021

(65) Prior Publication Data

US 2022/0397031 A1 Dec. 15, 2022

(51) Int. Cl.
*E21B 47/11* (2012.01)
*E21B 23/03* (2006.01)

(52) U.S. Cl.
CPC ..... *E21B 47/11* (2020.05); *E21B 23/03* (2013.01)

(58) Field of Classification Search
CPC ..... E21B 47/11; E21B 23/03
See application file for complete search history.

(56) References Cited

U.S. PATENT DOCUMENTS

| | | | |
|---|---|---|---|
| 9,359,886 | B2 | 6/2016 | Cameron |
| 2013/0075090 | A1 | 3/2013 | Woiceshyn |
| 2013/0327528 | A1 | 12/2013 | Frost |
| 2015/0013972 | A1 | 1/2015 | Al-Rabeh |
| 2016/0010454 | A1 | 1/2016 | Sira et al. |

(Continued)

FOREIGN PATENT DOCUMENTS

| | | | |
|---|---|---|---|
| EP | 3553274 | A1 | 10/2019 |
| WO | 2017164863 | A1 | 9/2017 |

OTHER PUBLICATIONS

International Search Report and Written Opinion of the International Searching Authority for corresponding International Patent Application No. PCT/IB2019/059578, mailed Aug. 13, 2020.

(Continued)

*Primary Examiner* — Crystal J Lee
(74) *Attorney, Agent, or Firm* — Renner, Otto, Boisselle & Sklar, LLP

(57) ABSTRACT

A downhole receptacle for tracer installation, comprises a housing and a tracer material arranged within the housing. The tracer material is water soluble. And the housing has an outer shape that corresponds to an outer shape of a standard gas lift valve. Further a method for the installation of a downhole receptacle for a tracer includes the steps of (a) running completion with at least one side pocket mandrel with or without a pre-installed dummy gas lift valve; and (b) replacing the dummy gas lift valve with a downhole receptacle for a tracer or installing a downhole receptacle into the side pocket mandrel.

13 Claims, 5 Drawing Sheets

(56) References Cited

U.S. PATENT DOCUMENTS

Figure 1:
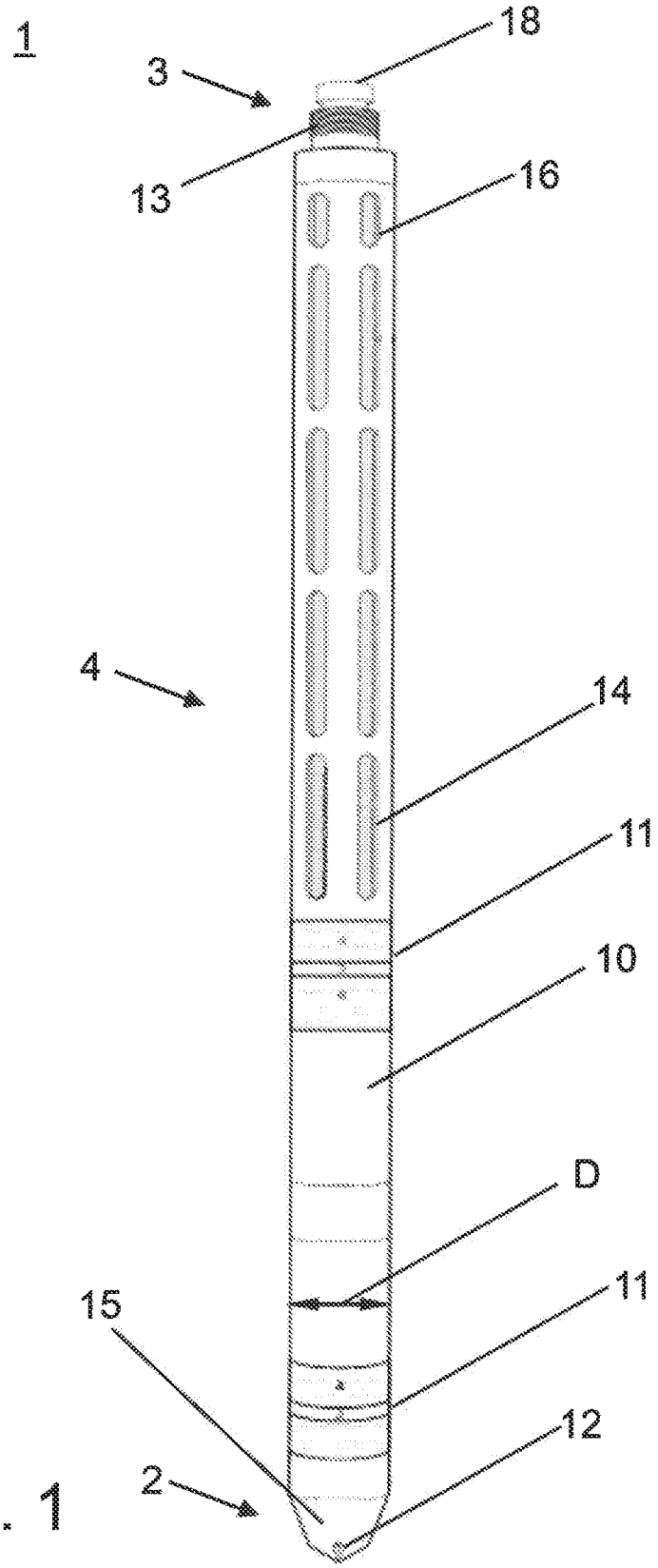

| | | | | |
|---|---|---|---|---|
| 2017/0167226 | A1 | 6/2017 | Barbato | |
| 2018/0363453 | A1* | 12/2018 | Canning | E21B 34/06 |

OTHER PUBLICATIONS

Extended European Search Report for corresponding Application No. EP 19 95 1260, issued on Apr. 11, 2023.
First Search and Examination Report issued by the Patent Office of the United Arab Emirates for the corresponding Emirati Patent Application No. P6000648/2022.

* cited by examiner

DOWNHOLE RECEPTACLE FOR TRACER INSTALLATION

This application is a national phase of International Application No. PCT/IB2019/059578, filed Nov. 7, 2019, and published in the English language, which is hereby incorporated herein by reference in its entirety.

FIELD OF THE INVENTION

The present invention relates to an easy and efficient way to deploy tracers in wellbores of multiple wells which are connected to the same facility (e.g. RDS—Remote Degasing Stations), wherein the wellbores are not equipped with surface sensors for watercut detection.

2. PRIOR ART

Detection of early water breakthrough in a well is a challenge in the oil and gas industry. The water cut detection is currently done either by surface testing, flowmeters or using downhole tracers embedded in the liners, especially for horizontal wells.

Chemical tracers embedded in a polymer matrix are being deployed downhole, especially in segmented horizontal wells via pre-perforated liners. The tracers, when exposed to water are released and they will travel to the surface where they are detected with chemical analysis. Although the technique is very useful to pinpoint water-breakthrough at a particular layer (zone) of the reservoir, it is CAPEX (capital expenditure) intensive and there is no possibility to change, replace or re-charge the tracer container with additional material.

There are also initiatives for surface tracer deployments in the well flowlines, however these are more expensive and complex because of safety issues and requiring involvement of surface engineering to deploy. Also, at surface, water could settle at the bottom of the flowline, and the water sampling could be biased. Although the deployment of the tracers can be placed at sandface against a particular zone (layer) of the reservoir, they are more expensive with a limited life time. Such tracers can not be replaced over time and, if required, the costs are prohibitive because a rig is required if at all possible.

The prior art document US 2017/0167226 A1 discloses a tracer assembly that becomes a portion of the tubular that is run into a wellbore. Preferably, the tracer assembly provides an exterior barrier to fluid outside of the tubular and also provides an interior barrier to fluid flow as it passes through the inner bore of the tubular.

The prior art document U.S. Pat. No. 9,359,886 B2 relates to systems and methods associated with a replenishable receptacle for tracer material in a wellbore. The tracer material receptacles can be disposed adjacent to a full-through bore and may be configured to be refilled with tracer material.

The function of the ReAct© Tracer Valve (RTV) is to introduce a chemical tracer into the production fluid, upon expiry of a pre-programmed time delay. It is normally installed as an integral part of the lower completion string in either the motherbore and/or lateral section of the well.

Although the above-mentioned prior art systems allow the use of a tracer material in a wellbore they use specifically designed receptacles for the individual system. Thus, such systems have a high CAPEX and are technically not easy to be replaceable, if at all. Thus, there is a need for a tracer installation and replacement that can be done in an easy and cost efficient manner and allows easy replacement of depleted tracer material.

3. SUMMARY OF THE INVENTION

The above-mentioned problem is solved by a downhole receptacle for tracer installation according to claim 1 and a method for the installation of a downhole receptacle for tracer according to claim 10.

Particularly the above-mentioned problem is solved by a downhole receptacle for tracer installation, comprising a housing; a tracer material arranged within the housing, wherein the tracer material is water soluble; and wherein the housing has an outer shape that corresponds to an outer shape of a standard gas lift valve.

The downhole receptacle provides a carrier that allows deploying tracer in the upper part of the well completion (tubing). Due to the outer shape of the downhole receptacle that corresponds to an outer shape of a gas lift valve, it can be preferably arranged within a side-pocket mandrel of the gas-lift valves. The location of the side-pocket mandrel can be above or below the packer (tail pipe). The tracer within the housing of the downhole receptacle is preferably used for the detection of water cut.

Since the downhole receptacle is preferably arranged within a side-pocket mandrel of the gas-lift valves or at a similar nipple, it may not provide the exact location of the source of the water, however, it provides an information if the well is producing water or not. This is particularly useful when multiple producing wells, without surface instrumentation, are connected to a Remote Degassing Station (RDS).

Since the housing has an outer shape that corresponds to an outer shape of a gas lift valve a low-cost option to deploy preferably chemical water tracers in the borehole is provided, that can be used to monitor water cut evolution over the life of the well or multiple wells, particularly if these wells are connected to a common RDS.

Further, since the proposed downhole receptacle can be installed in the side pocket of a common gas lift completion, it can be used in wells with no tracers in the horizontal drain. Also, this new technique allows the deployment of tracers at any time during the well life compared to the in-line tracers which need an early stage with the first completion installation. This is because the downhole receptacle, due to its other shape, can preferably be installed and retrieved by a common gas lift valve kickover tool using a slickline unit. This allows an early diagnosis of problematic water cut in producing wells, without the need to install more expensive surface or downhole equipment.

Preferably, the housing of the downhole receptacle is generally cylinder shaped. Preferably it has an external diameter of about 1.5 inches. Thus, the downhole receptacle is very slim and can be handled by slickline equipment.

Ideally, the downhole receptacle could contain a metallic mesh arranged within the housing, wherein the metallic mesh holds the tracer material, preferably if granular tracers are used. Preferably, the particles of the tracer material have a particular grain size.

Preferably, the tracer material is held by a polymer material, which does not necessarily require a mesh. Preferably, the tracer material is a chemical tracer material.

Preferably, the lower housing comprises at least one inlet opening and a set of upper slots, both connected with a flow path, and at least one top outlet opening for allowing a flow of fluid through the downhole receptacle.

Preferably, the lower inlet opening is arranged at the upstream end and the upper slot openings are arranged midstream of the downhole receptacle.

Preferably, at least one of the outlet openings is arranged at the cylinder wall of the downhole receptacle.

Preferably, the housing comprises threads at the downstream end of the downhole receptacle for connection to a gas lift valve deployment tool.

Preferably, the housing comprises a pointed end at the upstream end of the downhole receptacle. The pointed end is used as a guide to facilitate the setting of the device into a side-pocket mandrel of the completion.

Preferably, the pointed end comprises two lower inlet openings that have an enlarged size compared to a common gas lift valve, for providing a higher flow rate through the downhole receptacle.

A method for the installation of a downhole receptacle comprises the following two steps: 1.)—running completion with side pocket mandrels and pre-installed dummy gas lift valves; 2)—replacing the dummy gas lift valve(s) with a downhole receptacle for a tracer.

In another variant the method for the installation of a downhole receptacle comprises the following two steps: 1)—running completion with side pocket mandrels without pre-installed dummy gas lift valves; 2)—installing a downhole receptacle for a tracer into the side pocket mandrel.

Preferably, the step of replacing the dummy gas lift valve with a downhole receptacle comprises the standard step of retrieving the dummy gas lift valve by a wireline using a kickover tool.

Preferably, the method for the installation of a downhole receptacle for a tracer further comprises the step of replacing the downhole gas lift valve. This step is preferably done by the same procedure used to replace a dummy valve with a normal gas lift valve.

3. DESCRIPTION OF THE FIGURES

Figure 2:
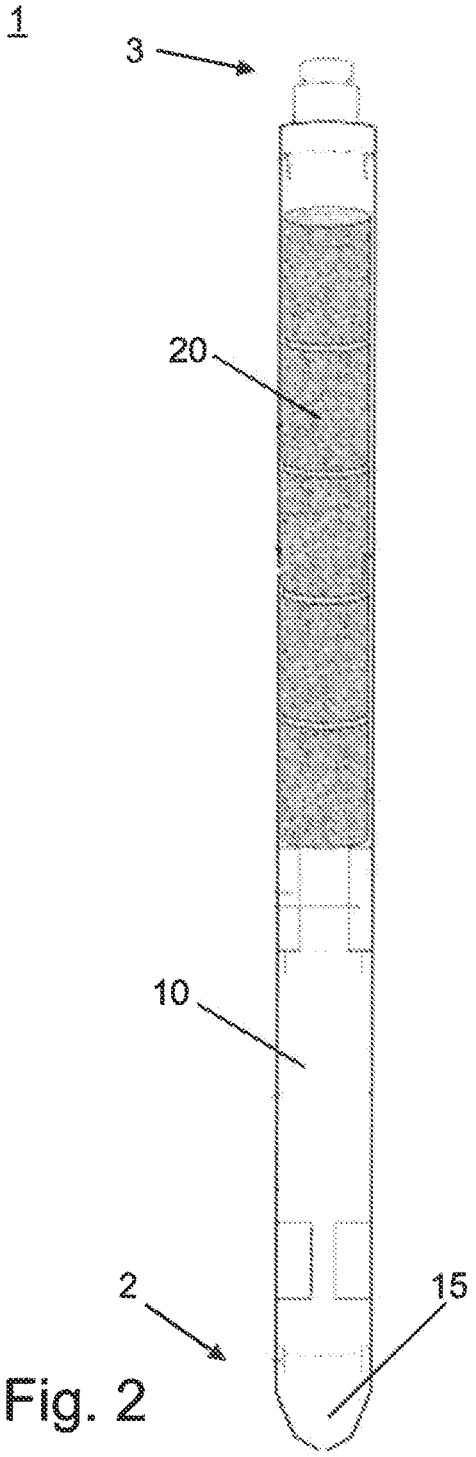
Figure 3:
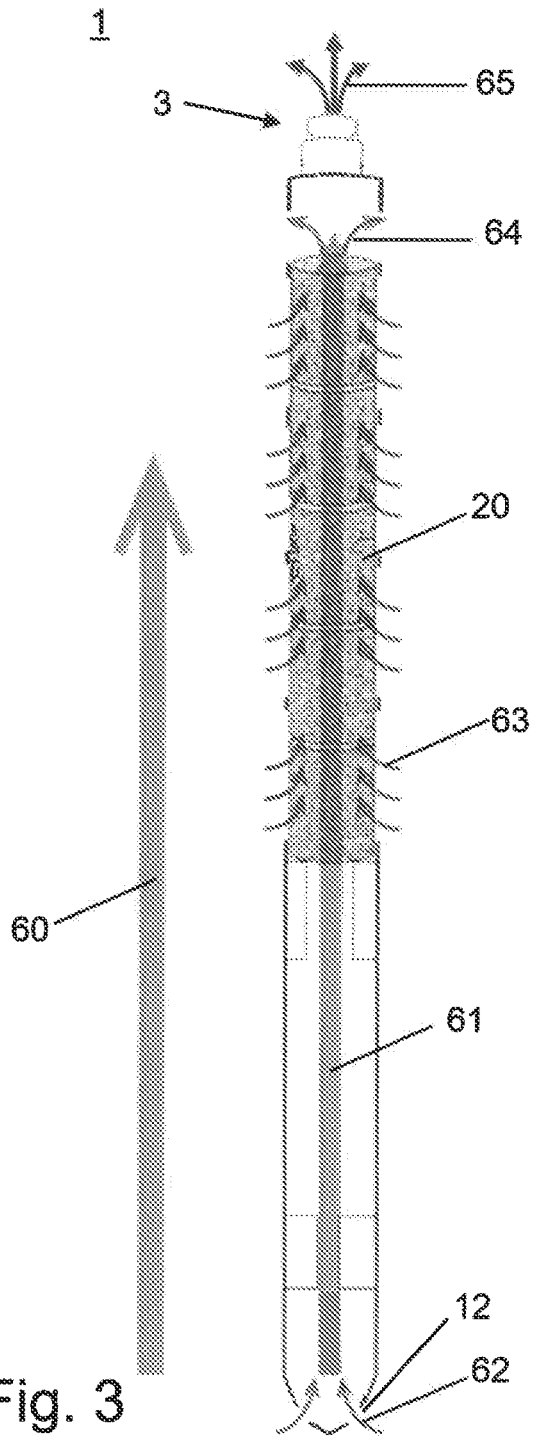
Figure 4A:
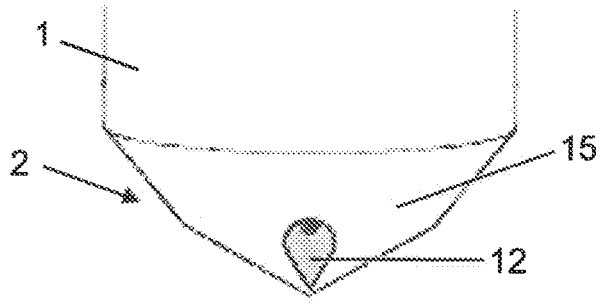
Figure 4B:
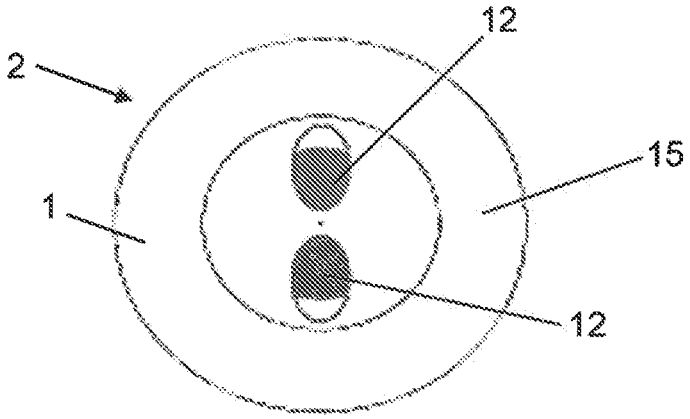
Figure 5:
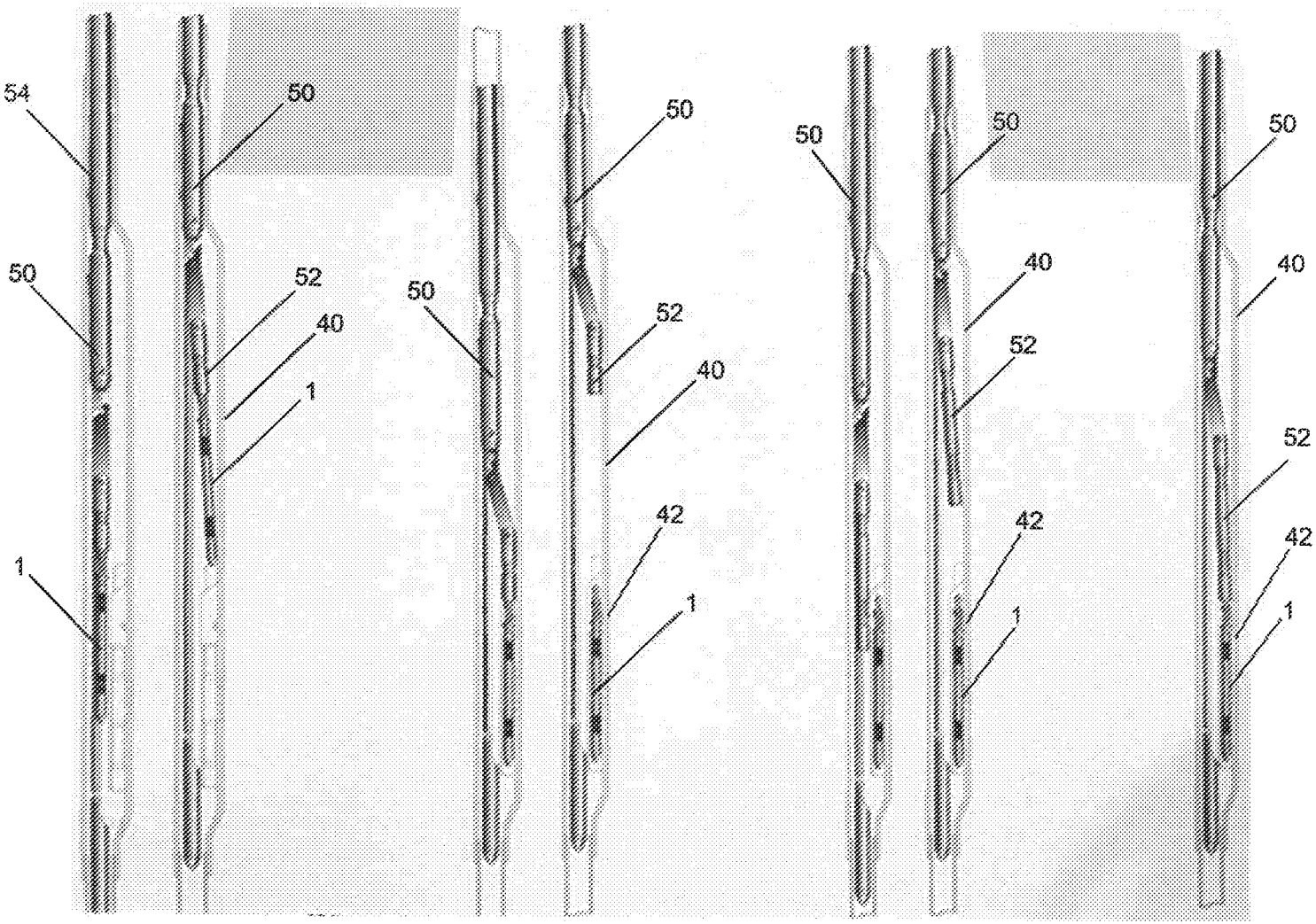
Figure 6:
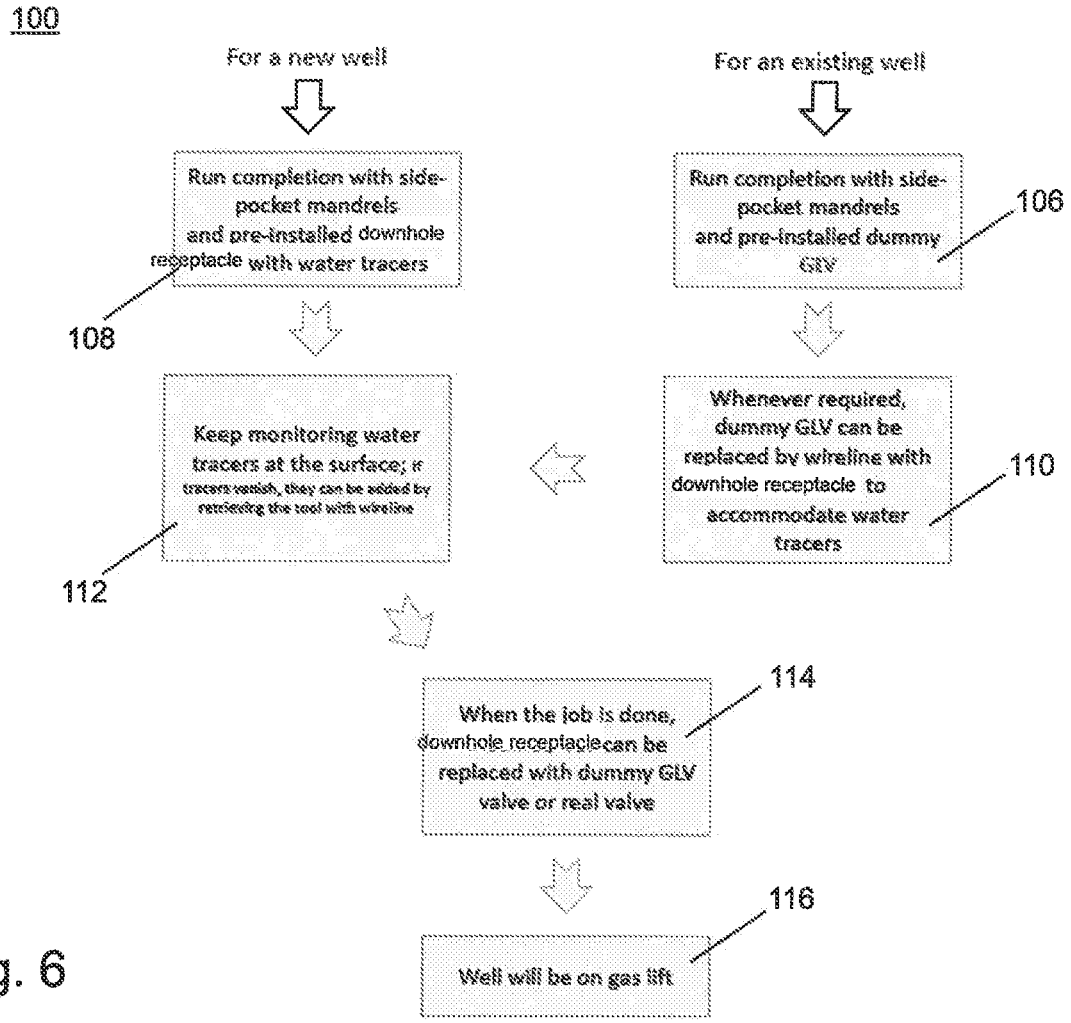

In the following preferred embodiments of the invention are disclosed by means of the figures. In which shows:

FIG. 1: a side view of a preferred embodiment of a downhole receptacle device for tracer installation;

FIG. 2: a side partially sectional view of the embodiment of FIG. 1, showing the interiors of the downhole receptacle;

FIG. 3: a schematic view of the fluid flow through the embodiment of FIG. 1;

FIG. 4A: a side view of the upstream end of the embodiment of FIG. 1;

FIG. 4B a bottom view of the upstream end of the embodiment of FIG. 1;

FIG. 5A-G schematic side views of a preferred running and pulling procedure for the downhole receptacle of FIG. 1; and FIG. 6 a flowchart for the installation process of a downhole receptacle within a new well and within an existing well.

4. DESCRIPTION OF PREFERRED EMBODIMENTS

In the following preferred embodiments of the invention are disclosed by means of the figures.

FIG. 1 shows side view of a preferred embodiment of a downhole receptacle 1 for tracer installation within a oil a producing well. The downhole receptacle 1 comprises housing 10 that contains a chemical tracer material 20. The chemical tracer material 20 is arranged within the upper part of the housing 10 and is water soluble to indicate water production of the well.

The housing 10 is preferably made of stainless steel. The seals 11 are made of Aflas or Chemraz type of materials, which are more resistant than neoprene. In H2S environments the housing could be made of inconel. It has an outer shape that corresponds to an outer shape of a standard gas lift valve or a dummy gas lift valve. Thus, the downhole receptacle can be installed instead of a dummy gas lift valve in a common side pocket mandrel 40 for a gas lift valve. The housing of the downhole receptacle 1 is generally cylinder shaped and has a diameter D of about 1 to 2 inches, preferably it has a diameter D of about 1.5 inches. The housing 10 comprises a pointed end 15 at the upstream end 2 of the downhole receptacle 1, which is adapted to be installed in a side-pocket mandrel 40 for a gas lift valve (see FIG. 5).

The downhole receptacle further comprises a metallic mesh or slots 14 arranged within the upper part of the housing 10, wherein the metallic mesh holds the chemical tracer material 20, which is preferably bound or held by a polymer material.

For allowing a fluid flow through the receptacle 1 the housing 10 comprises at least one inlet opening 12 upstream 2, a plurality of inlet openings or slots 14 midstream 4, arranged in longitudinal direction of the housing 10 and at least one outlet opening 16 downstream 3. In the shown embodiment the housing 10 has two inlet openings or noses 12 at the upstream end 2. The two inlet openings 12 at the upstream end 2 are shown in more detail in FIGS. 4A and 4B. They are preferably oval shaped and arranged on opposite sides of the pointed end 15.

The a least one of the outlet openings 16 is arranged at the cylinder wall of the downhole receptacle 1. In the shown embodiment the outlet openings 16 are preferably slot shaped and arranged also in longitudinal direction of the housing 10. The outlet openings 16 are arranged at the cylinder wall of the downhole receptacle 1 more downstream than the inlet openings 14. In addition, a further outlet opening 18 at the downstream end 3 of the downhole receptacle 1 may be provided.

FIG. 3 shows the liquid flow through the interior of the downhole receptacle 1. A part of the well's main flow 60 enters the inlet openings 12 at the upstream end 2 of the receptacle 1 as shown with arrow 62. This liquid forms partial flow 61 that flows longitudinally through the receptacle 1 and enters into the mesh holding the tracer material 20. In addition, another part of the well's main flow 60 leaves and/or enters the inlet/outlet openings 14 in the cylinder wall and also flows through the mesh holding the tracer material 20 as shown by arrows 63. These flows release a part of the tracer material 20 from the mesh that mixes with the liquid flow in the well. Part of the liquid flow leaves slots 16, of the receptacle 1 and part at the downstream end 3 through the outlet openings 18 as shown by arrows 64 and 65 and mixes with the main flow in the wellbore 60.

For running and pulling the downstream receptacle 1, the housing 10 comprises threads 13 at the downstream end 3 of the downhole receptacle 1 for connection to a gas lift valve deployment tool 50, 52. As shown in FIGS. 5A to 5G a common gas lift valve deployment tool 50 can be used to install, pull or replace a downstream receptacle 1. FIG. 5A shows the common gas lift valve deployment tool 50 with connection arm 52 in-line with the main body 54 of the tool 50. The downhole receptacle 1 is connected to the connection arm 52 via threads 13. If the deployment tool 50 is pulled upwards, as shown in FIG. 5B, the connection arm 52 pivots outwardly and moves downhole receptacle 1 outwardly, such that it can enter by its pointed end 15 into a side pocket 42 of a gas lift valve mandrel 40. Afterwards the deployment tool 50 is moved further down to fully insert the downhole receptacle 1 into the side pocket 42, as shown in FIG. 5C.

If the downhole receptacle 1 is correctly placed within the side pocket 42 it can be released from the connection arm 52. Then the gas lift valve deployment tool 50 can be pulled out of the tubing as shown in FIG. 5D leaving the downhole receptacle 1 in installed position.

The pulling of the downhole receptacle 1 can be also done by a common gas lift valve deployment tool 50. For the pulling the gas lift valve deployment tool 50 comprises a pulling arm 54 that pivots outwardly, when moving along a gas lift valve mandrel 40, as shown in FIGS. 5E and F. If the deployment tool 50 is moved downwards the pulling arm 54 moves outwardly and can connect to the threads 13 at the downstream end 3 of the receptacle 1, as shown in FIG. 5G. When the receptacle 1 is securely connected to the pulling arm 54 the deployment tool 50 can be moved upwards to pull the downhole receptacle 1.

The use of the downhole receptacle 1 enables an easy and fast installation of tracers and replacement if the tracer material is exhausted. A method for the installation of the downhole receptacle 1 in an existing well for a tracer is shown in FIG. 6 and may comprise the following steps:

a. running completion with side pocket mandrels and pre-installed dummy gas lift valves (step 106);
b. replacing the dummy gas lift valve with a downhole receptacle for a tracer (step 110).

Thus, preferably for an existing well, a conventional gas lift valve or a dummy gas lift valve can be easily replaced by a downhole receptacle 1 to allow tracing of water if required. The step of replacing the dummy gas lift valve with a downhole receptacle 1 comprises the step of retrieving the dummy gas lift valve by a wireline using a kickover tool. The retrieving is followed by a step of inserting the downhole receptacle 1 into the side pocket mandrel 40 by a kickover tool 50.

In case of a new well, the completion can be run already with installed downhole receptacles 1 (step 108). Thus, the downhole receptacle 1 installation is already included in the completion cost of a conventional well requiring gas lift in the future.

If the fresh downhole receptacles 1 are installed existing water in the fluid flow 60 (see FIG. 3) can be monitored (step 112). If the tracers 20 are exhausted and further monitoring of water is required, the downhole receptacles 1 can be pulled and new or re-filled downhole receptacles 1 can be run as described above.

If no further monitoring of water is necessary or if gas lift valves are required the downhole receptacle 1 for a tracer can be replaced with a gas lift valve (step 114). Then the well will be on gas lift (step 116).

The downhole receptacle 1 is preferably installed in the vertical section of the well, in the upper completion, above the packer, located inside a side-pocket mandrel 40 for a gas lift valve.

Thus, the downhole receptacle 1 according to the present invention provides a low-cost and reliable solution to trace water in a well bore. This is particularly useful in a multi-well scenario, where several strings are connected to a RDS (Remote Degassing Station).

The invention claimed is:

1. A downhole receptacle for tracer installation, comprising:

a. a housing;
b. a tracer material arranged within the housing, wherein the tracer material is water soluble; and wherein
c. the housing has an outer shape that corresponds to an outer shape of a standard gas lift valve, wherein the housing includes threads at a downstream end of the downhole receptacle for connection to a gas lift valve deployment tool.

2. The downhole receptacle according to claim 1, wherein the housing is cylinder shaped and has a diameter of about 1.5 inches.

3. The downhole receptacle according to claim 1, further comprising a metallic mesh or slots arranged within an upper part of the housing that hold the tracer material.

4. The downhole receptacle according to claim 1, wherein the tracer material is embedded into a matrix of a polymer material or is inserted into the housing as particles.

5. The downhole receptacle according to claim 1, wherein a lower part of the housing comprises at least one inlet opening and a set of upper slots, both connected with a flow path, and at least one top outlet opening for allowing a flow of fluid through the downhole receptacle.

6. The downhole receptacle according to claim 5, wherein a lower inlet opening is arranged at an upstream end and the set of upper slots are arranged midstream of the downhole receptacle.

7. The downhole receptacle according to claim 5, wherein the outlet opening is arranged at a cylinder wall of the downhole receptacle.

8. The downhole receptacle according to claim 1, wherein the housing comprises a pointed end at an upstream end of the downhole receptacle.

9. The downhole receptacle according to claim 8, wherein the pointed end comprises two lower inlet openings that have a larger size compared to an opening of a common gas lift valve to provide a higher flow rate through the downhole receptacle compared to the flow rate through the common gas lift valve.

10. A method for the installation of the downhole receptacle for a tracer according to claim 1, comprising the following steps of:

a. running completion with at least one side pocket mandrel with a pre-installed dummy gas lift valve; and
b. replacing the dummy gas lift valve with the downhole receptacle for a tracer.

11. The method for the installation of a downhole receptacle according to claim 10, wherein the step of replacing the dummy gas lift valve with a downhole receptacle comprises the step of retrieving the dummy gas lift valve using a slickline and a kickover tool.

12. The method for the installation of a downhole receptacle according to claim 10, wherein the step of replacing the dummy gas lift valve with a downhole receptacle comprises the step of inserting the downhole receptacle into the side pocket mandrel by a kickover tool.

13. A method for the installation of the downhole receptacle for a tracer according to claim 1, comprising the following steps of:

a. running completion with at least one side pocket mandrel without a pre-installed dummy gas lift valve; and
b. installing the downhole receptacle for a tracer into the side pocket mandrel.

* * * * *